United States Patent [19]

Perez-Aguilar

[11] 3,954,023

[45] May 4, 1976

[54] AUTOMATIC LOCK AND RELEASE MECHANISM FOR OPENING MOVABLE-SLAT WINDOWS

[76] Inventor: Guillermo Perez-Aguilar, Pino 343-C, Mexico City 4, D.F. Mexico

[22] Filed: Dec. 6, 1974

[21] Appl. No.: 530,323

[30] Foreign Application Priority Data

Dec. 11, 1973 Mexico ..... 148019

[52] U.S. Cl. ..... 74/533; 49/87; 16/175

[51] Int. Cl.[2] ..... G05G 5/06

[58] Field of Search ..... 49/87, 89, 82; 292/207; 16/175; 74/533, 475

[56] References Cited

UNITED STATES PATENTS 3,180,174 4/1965 Walter ..... 74/475

3,537,331 11/1970 Rifkin ..... 49/87

FOREIGN PATENTS OR APPLICATIONS 539,615 2/1956 Italy ..... 74/533

*Primary Examiner*—Samuel Scott
*Assistant Examiner*—Wesley S. Ratliff, Jr.
*Attorney, Agent, or Firm*—Ladas, Parry, Von Gehr, Goldsmith & Deschamps

[57] ABSTRACT

This invention refers in general to mechanisms and accessories for window fittings and more particularly to improvements in a lever actuating mechanism for opening or closing jalousie-type windows or the like, with an automatic locking and unlocking mechanism, placing the lattice strips of the window in any desired position, in a controlled and stable manner.

2 Claims, 7 Drawing Figures

AUTOMATIC LOCK AND RELEASE MECHANISM FOR OPENING MOVABLE-SLAT WINDOWS

BACKGROUND OF THE INVENTION

Jalousie-type windows presently occupy an important position in the field of construction, because of their aesthetic appeal and functionalism, among other advantages.

Nothwithstanding the foregoing, up to the present time this type of movable-slat window has depended for its operation on systems of levers which, after a certain usage, become loose and therefore do not prevent the strips or slats from being moved by an external agency such as the air; the strips then move and thereby either permit or impede the passage of air contrary to the desired position.

Other mechanisms are known in addition to those of the simple lever for moving the slats of the jalousie-type windows, such as those of rack and pinion, which are of course costly and difficult to manufacture; in addition after a certain period of use wear is produced between mating teeth which leads to failure of the mechanism, so that it does not guarantee a proper positioning or perfect closure.

In my Mexican Pat. No. 107,199, I disclosed a system for fixing the slats of a jalousie-type window consisting of a tongue or pawl releasable by means of a sliding lever system, which is resiliently biassed to catch in a slotted sector having as many slots as the number of the desired fixed positions for the slats of the window.

The mechanism described in that patent, notwithstanding the substantial advantages it offers, has been considerably improved both in its structural parts and its operation by the automatic actuating mechanism covered in the present patent application, in which the sliding lever is not required to lock or unlock the pawl, because it includes a cam mechanism which by the mere movement of the principal lever compels a double ratchet to catch and to release from a fixed position without special care of effort by the user. In other words, by the mere movement of the principal lever, the user operates indirectly an automatic mechanism which releases a double ratchet, which will lock again in the position in which the user leaves the window slats, thus affording a simple mechanism which without requiring additional pressure firmly secures the slats or leaves of a jalousie-type window in the desired position, preventing them from being moved by an external agency such as the wind.

SUMMARY OF THE INVENTION

The improved mechanism of the present invention is composed of a case or housing connectable to a structural member which supports by means of brackets or suitable devices the slats or strips which make up the jalousie-type window; this case or housing includes in its interior two plates which turn on pivots therein and which can be engaged by means of gear teeth; one of the plates constitutes the end of a link or articulated mechanism which moves upward or downward an operating arm to which the brackets supporting the window strips are secured by pivot. Hence when this plate is rotated the jalousie-type window will be opened or closed; the other plate is directly actuated by the lever extending outward of the said case or housing and which includes a two-step recess of different depths, in the first of which is pivotally mounted the actuating lever by means of a pin which projects from the end thereof, the said actuating lever being moved by the user, and in the second step of the said recess beneath a portion of the lever there is mounted a small plate having two tonques or pawls projecting therefrom and being biassed by a spring mounted in the deepest portion of the second step of the recess in the main plate so that it is pressed into the slots or grooves formed in the wall of the housing; between the ratchets of this latter plate and in the deeper recess is placed a free triangular cam having a perforation into which is introduced a pin which likewise extends from the lever moved by the user, spaced a certain distance from the one first mentioned; by means of this mechanism when the user moves the lever slightly he actuates immediately, by means of the first pin which projects therefrom, the triangular cam which upon turning pushes the ratchet against the spring action disengageing it from the slot in which it lies, therefore, when the lever rests in the wall of the recess where it is also pivoted by means of the second pin at the extreme projecting from the same, makes the first actuating plate turn inasmuch the trip is liberated, driving the second plate that constitutes the extreme of the articulated mechanism that moves the slats of the jalousie-type window.

Once the lever reaches the position which the user desires, by the action of the spring which presses on the double-ratchet plate the triangular cam returns to its neutral position and the ratchet engages in two of the slots or recesses formed in the inside wall of the housing. Accordingly the user will not be aware of the moment at which the mechanism engages or releases the position of the slots of the jalousie-type window, thus producing an engaging and releasing movement which is automatic and smooth.

The present invention includes other construction characteristics besides those previously described that will be bétter understood and realize worth reading the following description which makes reference to the attached drawings, illustrating the preferred embodiment of the invention.

DETAILED DESCRIPTION OF THE INVENTION

Figure 1:
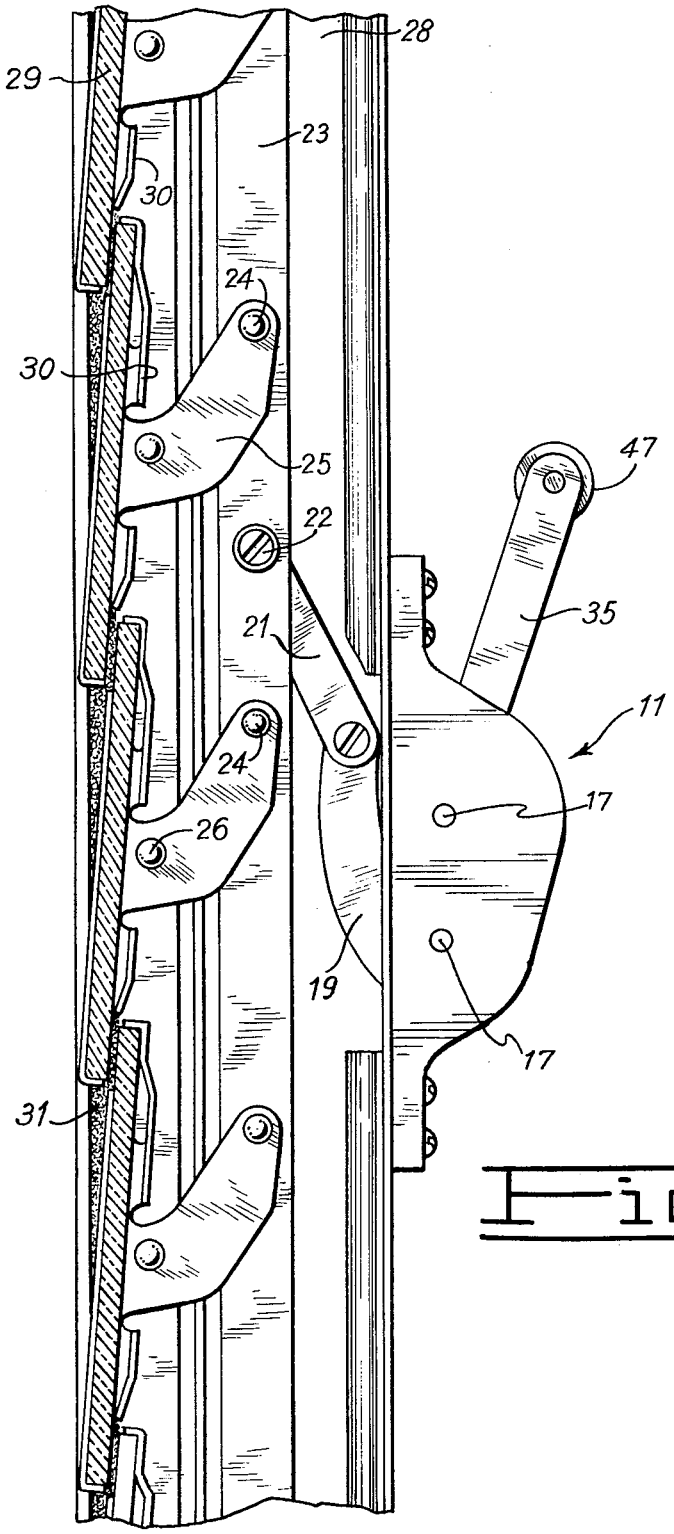
FIG. 1 is a view in lengthwise cross-section of a frame and window of the jalousie-type into which the mechanism of the present invention has been incorporated in the closed position of the window.
Figure 2:
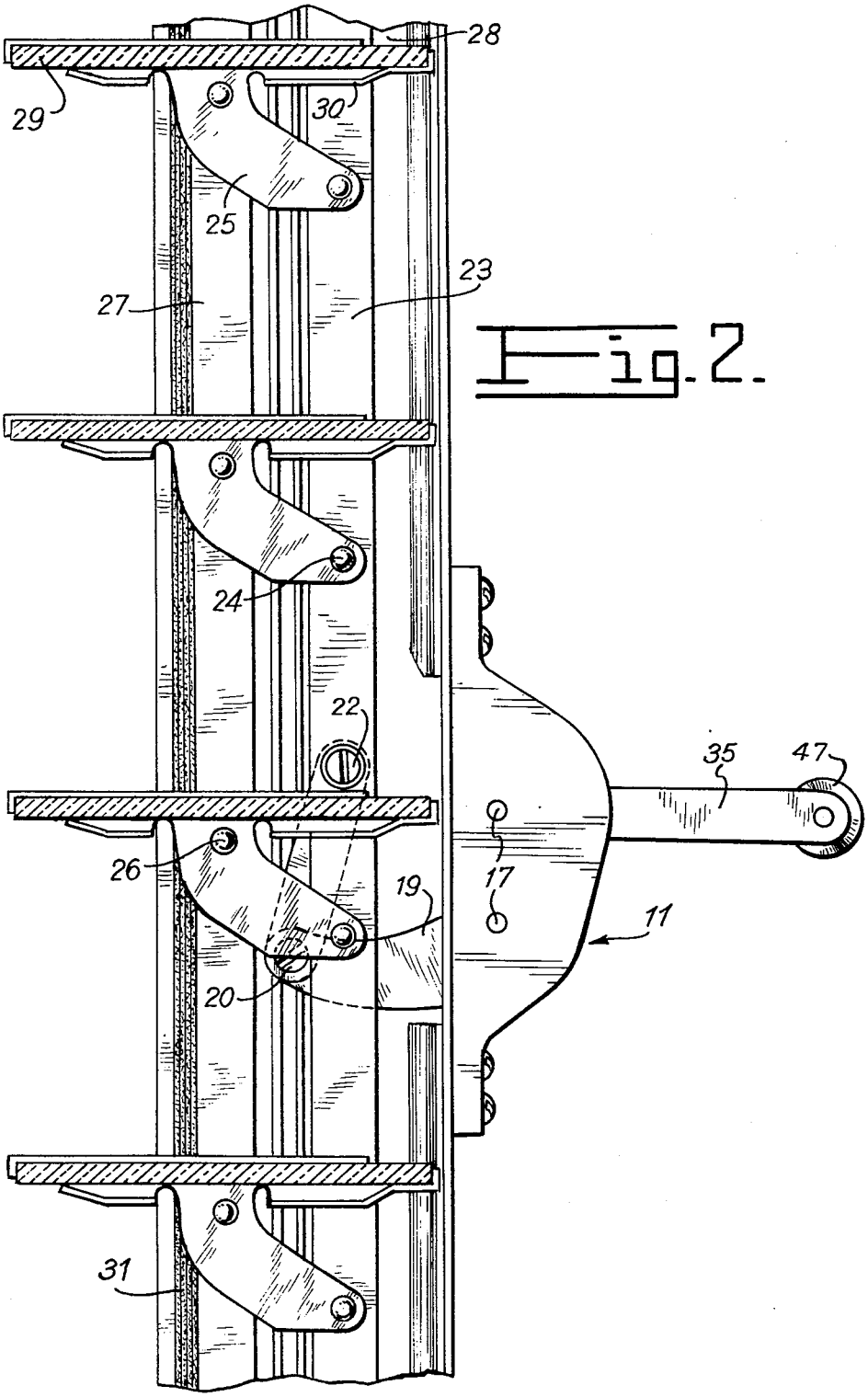
FIG. 2 is a view similar to that of FIG. 1, in which the lever has been actuated to open the jalousie-type window.
Figure 3:
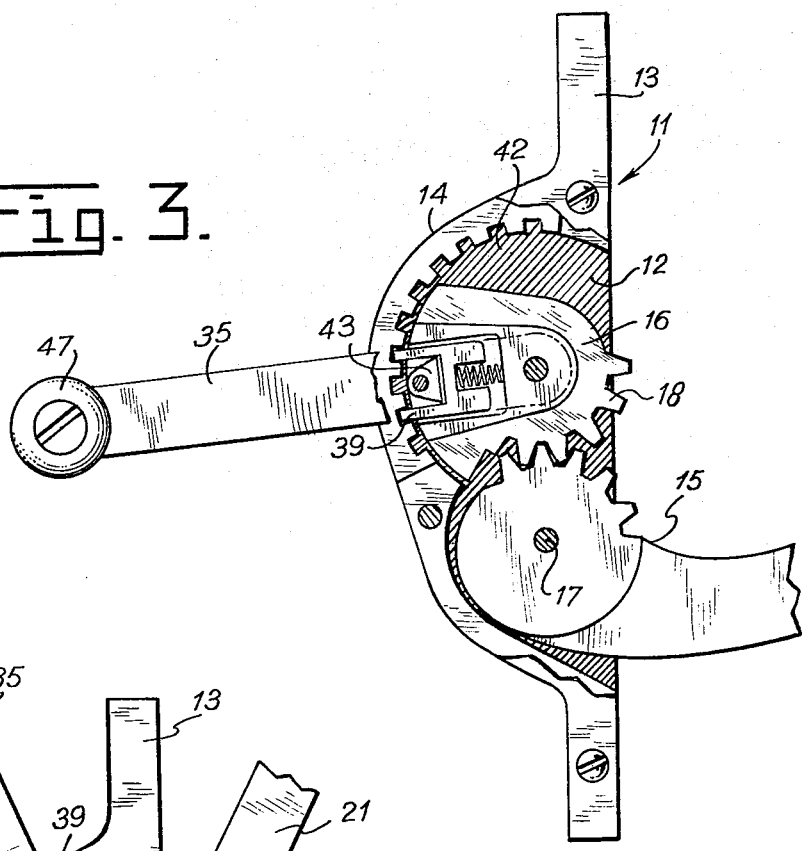
FIG. 3 is a view in detail with conventional cross-sections showing the improved lever mechanism of the present invention, illustrating the internal parts of which it is constituted in the position in which the automatic locking mechanism is engaged.

The improved mechanism of this invention is composed of a case having a bottom wall 12, a cover 13, and lateral walls 14, constituting an internal housing in which are located two plates 15 and 16 rotatably connected to the bottom wall 12 by means of pins 17, said plates 15 and 16 being engaged together by means of gear teeth 18. Plate 15 constitutes the end of a link 19 of the articulated mechanism for opening or closing the window; said link 19 has in its opposite end a pin or nut 20 which affords its rotatable engagement on either of the two sides of another link 21 which in turn has its opposite end likewise rotatably engageable by means of a nut or pin 22 to either of the two sides of an operating bar 23 to which are secured by means of pins 24 the rotating ends of supports 25, which in turn are secured at their opposite ends by means of other pins or pivots 26 to a portion 27 of the structure of window 28 which supports slats 29 by means of bent laminer brackets 30 whereby when operating bar 23 is lowered, as is illustrated in FIG. 2, brackets 25 are moved upward rotating upon pins or pivots 26, thus opening slots 29 which form the jalousie-type window, which may include seals 31 or any other frame or conventional device.

Figure 6:
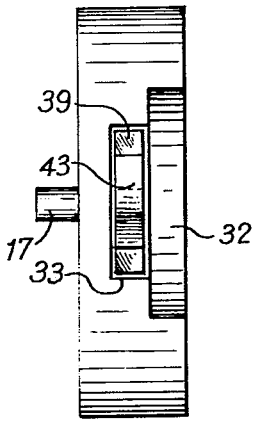
FIG. 6 is a view in vertical elevation of the plate and mechanism illustrated in FIG. 5.
Figure 5:
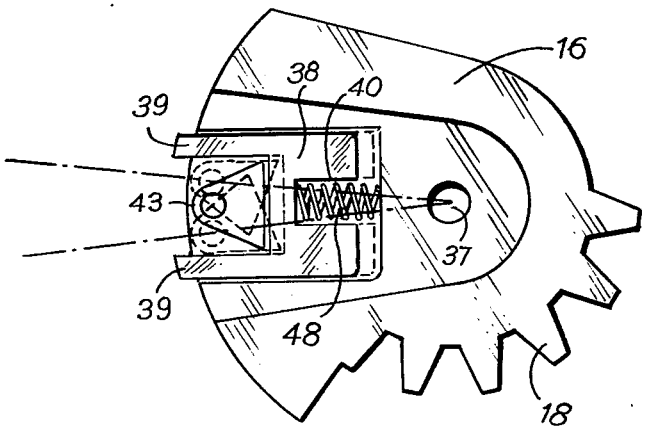
FIG. 5 is a view of the plate on which is mounted the end of the actuating lever and the automatic locking and unlocking mechanism of the present invention.
Figure 7:
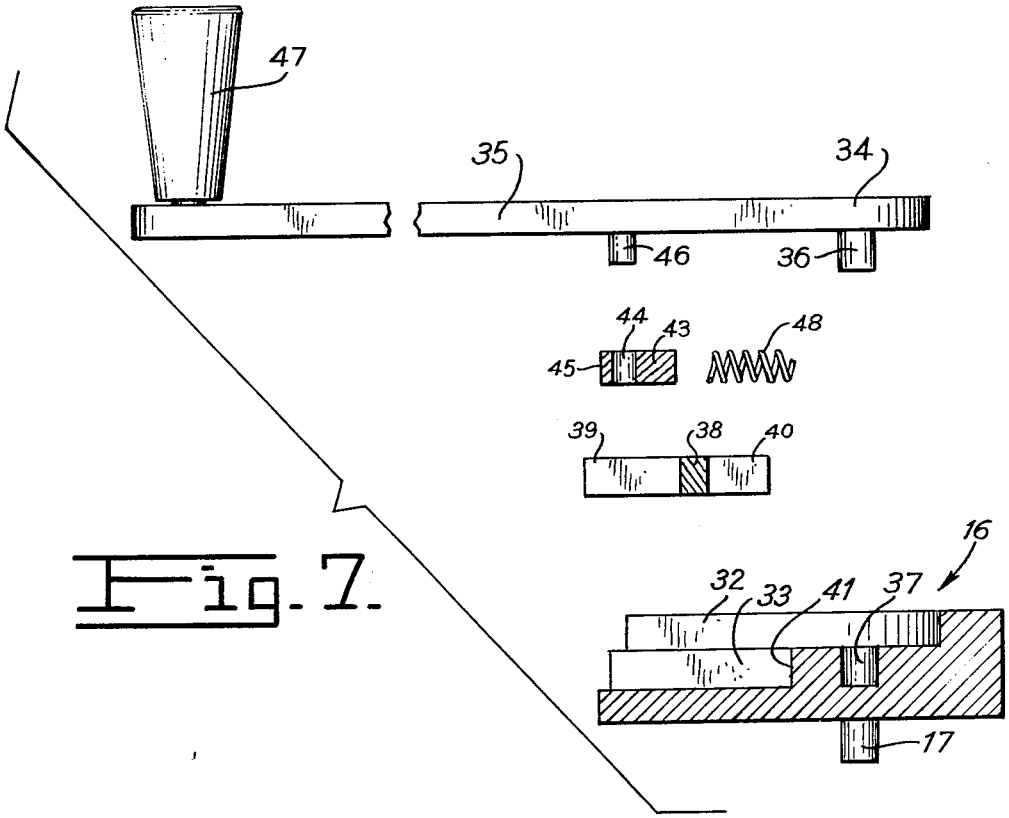
FIG. 7 is exploded view illustrating the plate and automatic mechanism of FIG. 5 including the actuating lever, which pieces when brought together produce the assembly of the automatic mechanism of the present invention.

The other plate 16 which in fact actuates the said plate 15 carries in addition to gear teeth 18, as can be observed in FIGS. 5 to 7, a first recess 32 in the interior of which it carries a second recess 33. In the first recess is placed the end 34 of the actuating lever 35, from whose lower surface extends first pin 36 which engages in a bore 37 formed in the bottom of the said first recess 32.

In second recess 33 is placed plate 38 from which there extend two tongues or pawls 39 there being a portion intermediate between said tongues 39. Plate 38 includes a slot 40 in which is carried a spring 48 which bears against the back 41 of the said second recess 33, pressing constantly upon pawls 39 of the ratchet in their locking position to force them to engage in slots or recesses 42 formed in the inside lateral wall of the housing.

Figure 4:
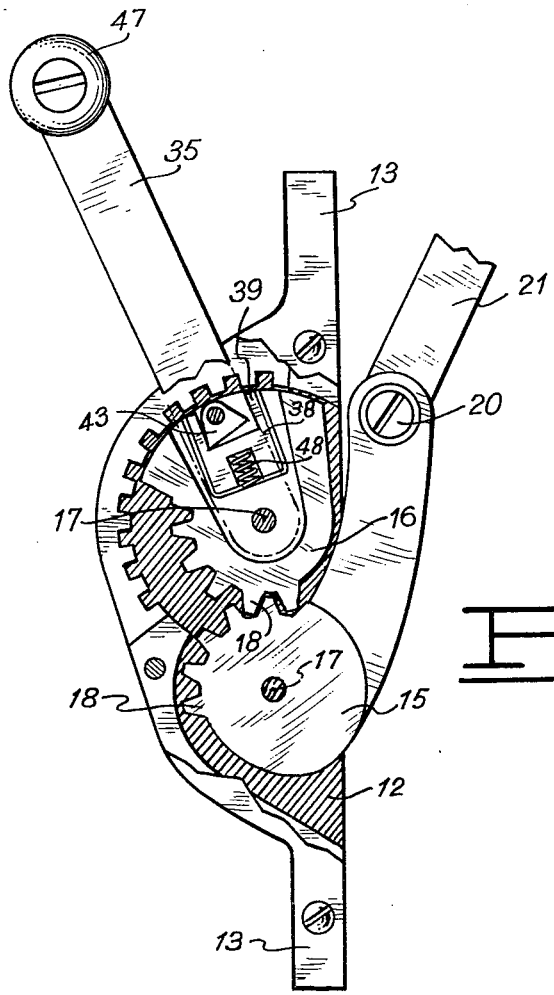
FIG. 4 is a view similar to that of FIG. 3 in which the automatic locking mechanism is freed.

An essential part of the automatic engaging and releasing mechanism of the present invention mounted between the two pawls 39 of plate 38, is a small triangular cam 43 having a bore 44 near its rounded corner 45. In said bore 44 is placed a second pivot 46 extending from the lower surface of lever 35, spaced a suitable distance from first pin or pivot 36; thus when the user moves lever 35 slightly by means of a knob 47 he will immediately forces that pin 46 moves triangular cam 43, as can be seen in FIGS. 4 and 5, hence releasing plate 38 against the pressure of spring 48, thus withdrawing pawls 39 from slots or grooves 32 formed in the inside wall of case 11.

Once the ratchet is released, the side wall of lever 35 bears against the edge of first recess 32, causing plate 16 to rotate around pin 17 and actuating plate 15 by means of gear teeth 18, which will open or close the jalousie-type window by means of the articulated mechanism described. Once lever 35 has reached the position desired by the user, cam 43 will return, because of the action of spring 48 which always bears against plate 38, to its position, in which it presses one of its sides against plate 38, thus allowing pawls 39 to enter slots 42, thus locking in a stable and secured position slots 29 which make up the jalousie-type window.

The great difference between this mechanism and all those now existing is that it produces a movement of automatic clutching and declutching or of engagement and release without the user detecting or feeling it and without requiring the movement of any addition lever or mechanism.

While the foregoing description has been drawn to a specific embodiment of the invention, it will be understood by those skilled in the subject that changes in form and detail are wholly included within the scope of the invention.

I claim:

1. An improved actuating lever to open or close movable-slat windows or the like with an automatic locking and release device, which includes a crank-like lever with a knob at its end for manipulation, which actuates a link of an articulated mechanism which moves the long bars of the window, which said bars in turn open or close said window, wherein the improved automatic locking and release mechanism comprises a housing including a bottom wall wherein first and second plates are pivotally mounted and are reciprocally engaged by means of gear teeth, the first of the two plates having two recesses therein one located within the other, said inner recess being deeper; one end of said crank-like lever having a pin which extends outwardly therefrom, said pin being disposed in a hole located in the bottom of the first recess, said lever forming a cover for the said second recess wherein is housed a plate from which there extends two spaced parallel pawls; said housing further including a lateral wall, said plate having a slot in the side opposite said pawls wherein is located a spring which continuously presses the plate against certain slots located in said lateral wall of said housing; located between said pawls in a triangular cam having a hole near one rounded vertex thereof, in said hole a pivot is disposed which projects outwardly from said crank-like lever and is colinearly spaced from said pin, the width of the first recess in said first plate is slightly greater than the width of the crank-like lever; the width of the triangular cam is less than the space separating said two pawls, and the second plate which is actuated by the gear teeth of the first plate forms the end of a link of the articulated mechanism for opening and closing the window.

2. An improved actuating lever for opening or closing movable-slat windows or the like as set forth in claim 1, wherein when the triangular cam is rotated by movement of the crank-like lever said pawls are removed from the slots in which they were disposed and are forced backwardly into a position in which they do not contact said slots or the surface of the lateral wall allowing said first plate to be rotated.

* * * * *